United States Patent [19]

Fencl

[11] 4,018,634

[45] Apr. 19, 1977

[54] METHOD OF PRODUCING HIGH STRENGTH STEEL PIPE

[75] Inventor: Vernon Fencl, Northbrook, Ill.

[73] Assignee: Grotnes Machine Works, Inc., Chicago, Ill.

[22] Filed: Dec. 22, 1975

[21] Appl. No.: 642,722

[52] U.S. Cl. ..... 148/131; 148/12 R; 148/155; 148/156; 72/367; 72/368; 228/151; 228/155

[51] Int. Cl.[2] ..... C21D 1/78; B21B 3/00; B23K 31/06

[58] Field of Search ..... 148/131, 130, 155, 156, 148/12, 13, 14, 127; 72/367, 368; 228/151, 155

[56] References Cited

UNITED STATES PATENTS

| | | | |
|---|---|---|---|
| 2,235,243 | 3/1941 | Adelson | 148/12 R |
| 2,843,512 | 7/1958 | Lodge | 148/131 |
| 3,535,484 | 10/1970 | Snow et al. | 148/127 |
| 3,915,763 | 10/1975 | Jennings et al. | 148/131 |

*Primary Examiner*—Walter R. Satterfield

*Attorney, Agent, or Firm*—Leydig, Voit, Osann, Mayer & Holt, Ltd.

[57] ABSTRACT

A method of treating steel pipe made by forming and welding a mother plate. The pipe is shrunk in the radial direction by applying compressive radial pressure to the outside surface of the pipe to reduce the pipe diameter by at least about 1%. The shrinking of the pipe increases the circumferential compressive yield strength and decreases the circumferential tensile yield strength. The pipe is then heated to a temperature below the transformation temperature of the steel but high enough to increase the circumferential tensile yield strength of the pipe, preferably at least about 15% above the tensile yield strength of the mother plate. The heating step does not significantly decrease the high circumferential compressive yield strength of the pipe. The pipe is preferably heated to a temperature within the range of from about 500° F to about 1000° F, and the preferred heating technique is induction heating.

9 Claims, No Drawings

METHOD OF PRODUCING HIGH STRENGTH STEEL PIPE

DESCRIPTION OF THE INVENTION

The present invention relates generally to the production of steel pipe and, more particularly, to a method of producing high strength steel pipe from flat plate.

In general, compressive deformation of steel pipe increases the compressive yield strength and reduces the tensile yield strength; conversely, tensile deformation of the pipe increases the tensile yield strength and reduces the compressive yield strength. In the case of pipe that is formed from flat plate by common "U-O" method, compressive deformation is used to convert the flat plate to round pipe, and thus the pipe as formed has a relatively high compressive strength and relatively low tensile strength (well below the tensile strength of the mother plate). When such pipe is to be used in applications requiring high tensile strengths, as in oil and gas pipelines, the requisite tensile strength is usually acquired by expanding the pipe; since this is a tensile load, it increases the tensile stress of the pipe (usually above the tensile strength of the mother plate), while reducing the compressive strength. Since the expansion of the pipe is usually effected by mechanical means, there is usually a minimum pipe diameter below which it is not feasible to carry out the expanding operation, especially in the case of pipe with a relatively large wall thickness.

It is a principal object of the present invention to provide an improved method of converting flat steel plate into pipe having a high circumferential tensile yield strength without the necessity of expanding the pipe. Thus, a related object of the invention is to provide such an improved method which does not require the use of any forming tools inside the pipe.

A more specific object of the invention is to provide such an improved method of converting flat steel plate into pipe having a circumferential tensile yield strength above the tensile yield strength of the mother plate.

It is a further object of the invention to provide an improved method of increasing the circumferential tensile yield strength of steel pipe which also increases the compressive yield strength of the pipe.

Another object of the invention is to provide such an improved method that produces steel pipe particularly suitable for submarine pipelines and casings.

Yet another object of the invention is to provide such an improved method of converting flat steel plate into high strength pipe that is economical to practice on a large scale.

Other objects and advantages of the invention will be apparent from the following detailed description.

While the invention will be described in connection with certain preferred embodiment, it will be understood that it is not intended to limit the invention to those particular embodiments. On the contrary, it is intended to cover all alternatives, modifications and equivalents as may be included within the spirit and scope of the invention as defined by the appended claims.

In accordance with the present invention, a steel pipe made by forming and welding a mother plate is shrunk in the radial direction by applying compressive radial pressure to the outside surface of the pipe diameter by at least about 1.5%, after which the pipe is heated to a temperature below the transformation temperature of the steel but high enough to increase the circumferential tensile yield strength of the pipe, preferably above the tensile yield strength of the mother plate. The shrinking step preferably reduces the outside diameter of the pipe by an amount between about 3% about 10%, and the pipe is preferably heated to a temperature within the range of from about 500° F to about 1000° F to increase the circumferential tensile yield strength of the pipe at least about 15% above the tensile yield strength of the mother plate.

The pipe of this invention is initially formed from a flat steel plate, commonly referred to as the "mother plate". The plate is selected to provide the required strength characteristics in the pipe, consistent with the particular method by which the pipe is formed and treated. Of course, it is always desirable to use the thinnest possible plate for economic reasons, but the requirements of modern large diameter submarine pipelines, and the techniques of laying these pipelines, have necessitated the manufacture of pipe with larger and larger wall thicknesses. For example, it has been reported that plans for a pipeline in the North Sea call for grade X-80 pipe that is 48 inches in diameter with 2-inch wall thickness.

To form the pipe, the mother plate is formed or pressed into a cylindrical configuration by successive stages of mechanical working. Machines and techniques for forming pipe in this manner, often referred to as "U-O forming", are well known. The metal plate is subjected to several different types of loads in the forming process, but the predominant deformation is compressive in the circumferential direction. Consequently, the formed pipe has a circumferential tensile yield strength considerably below that of the mother plate due to the "Bauschinger effect", i.e., plastically straining the metal in compression reduces the stress level at which the metal will subsequently yield in tension, and vice versa. The major portion of the Bauschinger effect normally occurs in the final stage of the forming process, in which the mother plate is pressed from a U-shape into the final O-shape.

After the mother plate has been formed into the shape of a cylinder, the longitudinal edges thereof are joined by welding, so that the final pipe has a continuous longitudinal weld seam. Conventional trimming and finishing operations are normally carried out after the welding operation to provide smooth end edges on the finished pipe.

In keeping with the present invention, the pipe is next subjected to a shrinking operation in which a compressive radial load is applied to the outside surface of the pipe to reduce the pipe diameter by at least about 1.5%, while also increasing the pipe wall thickness and length and strain hardening the steel. This shrinking operation may be carried out by conventional equipment which uses a circular array of dies to mechanically apply the desired radial load to the pipe. One example of this type of shrinking equipment is described in U.S. Pat. No. 3,461,710, issued Aug. 19, 1969 to H. R. Luedi and C. H. Stettler. The plastic compressive straining of the metal during the shrinking operation further increases the circumferential compressive yield strength of the pipe but reduces the circumferential tensile strength of the pipe, in accordance with the Bauschinger effect described above.

The benefits achieved by the method of this invention may by realized over a relatively wide range of degrees of shrinkage above about 1.5%. However, it is generally preferred to use a shrinking operation which reduces the outside diameter of the pipe by an amount between about 3% and about 10%. Of course, the shrinking operation also increases the wall thickness of the pipe, so the mother plate should have a thickness smaller than that required in the final pipe.

Following the shrinking operation, the pipe is heated to a temperature below the transformation temperature of the steel but high enough to increase the circumferential tensile yield strength of the mother plate. As used herein, the "transformation temperature" of the steel refers to the temperature at which austenitic transformation occurs, which generally requires temperatures above 1450° F. In the method of the present invention, the pipe is heated only to a temperature within the range of about 500° F. to about 1000° F, typically around 700° F.

The heat treatment of the pipe may be carried out by any suitable heating means, but it is preferred to use induction heating because of the efficiency and controllability of this particular heating technique. After the pipe has been heated to the required temperature, there is no need to hold the pipe at that temperature for any given length of time, and the pipe may be allowed to cool immediately.

It has been surprisingly found that this relatively low temperature heat treatment of the shrunk pipe results in significant increases in the circumferential tensile yield strength of the pipe, while retaining the high circumferential compressive yield strength, and the increase in the circumferential tensile yield strength becomes greater with greater degrees of shrinkage, e.g., in the 3 to 10% range. It appears that the heat treatment eliminates the Bauschinger effect which reduces the circumferential tensile yield strength during the forming and shrinking of the pipe, thereby increasing the circumferential tensile yield strength of the pipe, while retaining the strain hardening of the pipe which is apparently responsible for the high circumferential compressive strength. It has been found that this combination of shrinking and heating steps is capable of producing pipe with a circumferential tensile yield strength as high as that produced by conventional pipe expanding operations, but without the necessity of any internal forming tools and with a higher circumferential compressive strength. This combination of high circumferential tensile and compressive strength in the pipe is particularly desirable in submarine pipelines, in which the pipe is subjected to considerable compressive loads in addition to the normal tensile loads encountered in any pipeline. In the past, the shrinking of pipe has normally been used only to increase the compressive strength of the pipe, usually in casing the pipe rather than line pipe. Pipe produced by the present invention is suitable for both casing and line applications.

The present invention can be further understood from the following working examples:

EXAMPLES

A grade X-60 steel pipe with a 36-inch outside diameter and a 0.390-inch wall thickness was cut into two 18-inch lengths. The ends of these two 18-inch lengths were then reduced in diameter by shrinking in a Grotnes "Circumpress" feed-through shrinker to permanently shrink the four ends of the pipes by 1.5%, 3%, 4.5% and 6%, respectively. Samples of the pipe were then tested for transverse and longitudinal tensile yield strength (0.2%), transverse and longitudinal ultimate tensile strength, transverse and longitudinal elongation before and after shrinking, in accordance with the standard API (American Petroleum Institute) Spec. 5L for pipe. The results of these tests were as follows:

| Shrinkage, % | 0 | 1.5 | 3.0 | 4.5 | 6.0 |
|---|---|---|---|---|---|
| Circumferential Tensile Yield Strength, KSI | 68.2 | 64.9 | 65.6 | 66.2 | 68.6 |
| Circumferential Ultimate Tensile Strength, KSI | 86.4 | 78.0 | 78.6 | 78.5 | 78.9 |
| Circumferential Elongation, % | 34.0 | 34.0 | 33.0 | 34.3 | 31.8 |
| Longitudinal Tensile Yield Strength, KSI | | 78.3 | 81.3 | 85.2 | 88.6 |
| Longitudinal Ultimate Tensile Strength, KSI | | 85.5 | 85.9 | 89.5 | 89.8 |
| Longitudinal Elongation, % | | 29.5 | 27.5 | 27.5 | 26 |

Next, samples of the shrunk pipe were heated to 700° F. for 30 minutes and then allowed to cool to room temperature. The circumferential tests described above were then conducted with the following results:

| Shrinkage, % | 1.5 | 3.0 | 4.5 | 6.0 |
|---|---|---|---|---|
| Circumferential Tensile Yield Strength, KSI | 78.7 | 78.1 | 85.0 | 85.3 |
| Circumferential Ultimate Tensile Strength, KSI | 84.9 | 84.8 | 89.6 | 90.1 |
| Circumferential Elongation % | 30.5 | 30.8 | 27.0 | 24.0 |
| Longitudinal Tensile Yield Strength, KSI | 81.0 | 85.0 | 84.6 | 89.2 |
| Longitudinal Ultimate Tensile Strength, KSI | 86.2 | 89.0 | 89.1 | 92.2 |
| Longitudinal Elongation % | 29.3 | 28.5 | 27.3 | 26.5 |

Thus, the heat treatment increased the circumferential tensile yield strengths of the four samples, 21.3, 19.1, 28.4 and 24.3% above the corresponding yield strengths of the shrunk samples before the heat treatment, and 15.4, 14.5, 24.6 and 25.1% above the tensile yield strength of the mother plate. The ultimate circumferential tensile strengths were also increased 8.8, 7.9, 14.1and 14.2% above the corresponding ultimate strengths of the shrunk samples before the heat treatment.

I claim as my invention:

1. A method of treating steel pipe made by forming and welding a mother plate, said method comprising the steps of shrinking the pipe in the radial direction by applying compressive radial pressure to the outside surface of the pipe to reduce the pipe diameter by at least about 1.5% and thereby increase the circumferential compressive yield strength of the pipe, and then heating the pipe to a temperature below the transformation temperature of the steel but high enough to increase the circumferential tensile yield strength of the pipeabove the tensile yield strength of the mother plate.

2. A method of treating steel pipe as set forth in claim 1 wherein the shrinking step reduces the outside diameter of the pipe by an amount between about 3% and about 10%.

3. A method of treating steel pipe as set forth in claim 1 wherein said pipe is heated to a temperature within the range of from about 500° F to about 1000° F.

4. A method of treating steel pipe as set forth in claim 1 wherein said pipe is heated by induction heating.

5. A method of treating steel pipe as set forth in claim 1 wherein the shrunk pipe is heated to a temperature selected to yield a circumferential tensile yield strength at least about 15% above the tensile yield strength of the mother plate.

6. A method of treating steel pipe made by forming and welding a mother plate, said method comprising the steps of applying compressive radial pressure to the steel to plastically deform the same by at least about 1.5% in the radial direction and thereby increase the circumferential compressive yield strength and decrease the circumferential tensile yield strength, and then heating the steel to a temperature below the transformation temperature thereof but high enough to increase the circumferential tensile yield strength thereof above the tensile yield strength of the mother plate.

7. A method of treating steel pipe as set forth in claim 6 wherein said compressive radial pressure shrinks the pipe by an amount between about 3% and about 10%.

8. A method of treating steel pipe as set forth in claim 6 wherein the steel is heated to a temperature within the range of from about 500° F to about 1000° F.

9. A method of treating steel pipe as set forth in claim 6 wherein said compressive radial pressure increases the circumferential compressive yield strength of the pipe above the compressive yield strength of the mother plate, and the temperature to which the pipe is subsequently heated is low enough to maintain the circumferential compressive yield strength of the pipe above the compressive yield strength of the mother plate.

* * * * *